US007674152B2

(12) United States Patent
Anderson

(10) Patent No.: US 7,674,152 B2
(45) Date of Patent: Mar. 9, 2010

(54) ENHANCED BALLOON WEIGHT SYSTEM

(75) Inventor: Brent Anderson, Barrington, IL (US)

(73) Assignee: CTI Industries, Inc., Barrington, IL (US)

( * ) Notice: Subject to any disclaimer, the term of this patent is extended or adjusted under 35 U.S.C. 154(b) by 486 days.

(21) Appl. No.: 11/072,921

(22) Filed: Mar. 3, 2005

(65) Prior Publication Data

US 2006/0199465 A1 Sep. 7, 2006

(51) Int. Cl.
*A63H 3/06* (2006.01)

(52) U.S. Cl. ..... 446/220; 446/224

(58) Field of Classification Search ..... 446/175, 446/220, 226, 397, 223, 235, 236, 274, 248, 446/486; 244/31; 84/94.2
See application file for complete search history.

(56) References Cited

U.S. PATENT DOCUMENTS 2,646,019 A 7/1953 Chetlan
2,683,937 A 7/1954 Criswell
3,592,157 A 7/1971 Schwartz
3,672,083 A 6/1972 Moran
3,863,915 A 2/1975 Pifer
3,879,887 A 4/1975 Brookson, Jr. et al.
4,015,111 A 3/1977 Spector
4,030,237 A 6/1977 Lewis
4,195,794 A 4/1980 Ricci et al.
4,470,218 A 9/1984 Yu
4,638,207 A 1/1987 Radice
4,639,232 A 1/1987 Wong
4,693,695 A 9/1987 Cheng
4,704,934 A 11/1987 Nosrati
4,736,281 A 4/1988 Neumeier
4,779,816 A 10/1988 Varlet
4,823,907 A 4/1989 Hoshi
4,843,275 A * 6/1989 Radice ..... 310/334
4,917,323 A 4/1990 Wing
4,936,532 A 6/1990 Williams
4,993,664 A 2/1991 Kneeland
5,035,391 A 7/1991 Steele et al.
5,074,510 A 12/1991 Metz
5,108,338 A 4/1992 Margolis
5,117,344 A 5/1992 Perez
5,119,281 A 6/1992 Akman
5,183,329 A 2/1993 Chen
5,188,314 A 2/1993 Peters
5,203,530 A 4/1993 Liu
5,215,492 A 6/1993 Kubiatowicz
5,240,199 A 8/1993 Peters
5,255,866 A 10/1993 Campolo
5,259,805 A 11/1993 Kieves
5,265,822 A 11/1993 Shober et al.
5,411,427 A 5/1995 Nelson et al.

(Continued)

FOREIGN PATENT DOCUMENTS

CN 1258904 7/2000

(Continued)

*Primary Examiner*—Nini Legesse
(74) *Attorney, Agent, or Firm*—Joseph A. Fuchs; Rockey, Depkey & Lyons, LLC

(57) ABSTRACT

The present invention provides a balloon weight system for an inflatable balloon having, singularly or in any combination, an electronic music producing device, a line distance adjusting device, to produce a descending and/or ascending of the balloon, and a fragrance distribution device.

5 Claims, 3 Drawing Sheets

U.S. PATENT DOCUMENTS

| | | | |
|---|---|---|---|
| 5,444,607 | A | 8/1995 | Dreyfus |
| 5,577,947 | A | 11/1996 | Malloy et al. |
| 5,628,091 | A | 5/1997 | Mueller |
| 5,639,076 | A | 6/1997 | Cmiel et al. |
| 5,662,510 | A | 9/1997 | Wolens |
| 5,738,560 | A | 4/1998 | Bears |
| 5,755,419 | A | 5/1998 | Gearhart et al. |
| 5,782,668 | A | 7/1998 | Chabert |
| 5,795,211 | A | 8/1998 | Carignan et al. |
| 5,797,783 | A | 8/1998 | Harris |
| 5,807,157 | A | 9/1998 | Penjuke |
| D401,255 | S | 11/1998 | Burns |
| D414,222 | S | 9/1999 | Kieves et al. |
| 5,957,401 | A | 9/1999 | O'Donnell |
| D415,841 | S | 10/1999 | Kieves et al. |
| 5,964,636 | A | 10/1999 | Carrera |
| 5,989,093 | A | 11/1999 | Nelson et al. |
| 6,001,434 | A | 12/1999 | Zinbarg et al. |
| 6,033,113 | A | 3/2000 | Anderson |
| 6,065,709 | A | 5/2000 | Wagter et al. |
| 6,076,758 | A | 6/2000 | Kieves et al. |
| 6,106,135 | A | 8/2000 | Zingale et al. |
| 6,142,415 | A | 11/2000 | Ambrico |
| 6,164,582 | A | 12/2000 | Vara |
| 6,167,924 | B1 | 1/2001 | Buckley et al. |
| 6,178,915 | B1 | 1/2001 | Salandra |
| 6,238,067 | B1 | 5/2001 | Hirsch |
| 6,238,259 | B1 | 5/2001 | Medina |
| 6,276,815 | B1 | 8/2001 | Wu |
| 6,286,777 | B1 | 9/2001 | Black |
| 6,371,638 | B1 | 4/2002 | Zingale et al. |
| 6,390,651 | B2 | 5/2002 | Bertrand |
| 6,394,873 | B1 | 5/2002 | Bernard |
| 6,431,489 | B1 | 8/2002 | Rose |
| 6,435,688 | B1 | 8/2002 | Pittman |
| 6,482,065 | B1 | 11/2002 | Blackman |
| 6,497,381 | B2 | 12/2002 | Rose |
| 6,602,105 | B1 | 8/2003 | Sussell |
| 6,609,945 | B2 | 8/2003 | Jimenez et al. |
| 6,631,811 | B2 | 10/2003 | Komar et al. |
| 6,632,120 | B2 | 10/2003 | Blackman et al. |
| 6,716,083 | B1 * | 4/2004 | Castro ..... 446/220 |
| 6,739,725 | B2 | 5/2004 | Ben-Ari |
| 6,821,183 | B2 | 11/2004 | Blackman et al. |
| 2001/0034176 | A1 | 10/2001 | Deliu |
| 2003/0045202 | A1 | 3/2003 | Kumar et al. |
| 2003/0057580 | A1 | 3/2003 | Rosenberg |
| 2003/0138120 | A1 | 7/2003 | Tripoli, III |
| 2003/0197084 | A1 | 10/2003 | Anderson |
| 2004/0174718 | A1 | 9/2004 | Ohlund |

FOREIGN PATENT DOCUMENTS

| | | |
|---|---|---|
| GB | 2130552 A | 6/1984 |
| WO | WO 87/05821 | 10/1987 |

* cited by examiner

ENHANCED BALLOON WEIGHT SYSTEM

CROSS-REFERENCE TO RELATED APPLICATION

Not applicable.

FEDERALLY SPONSORED RESEARCH OR DEVELOPMENT

Not applicable.

BACKGROUND OF THE INVENTION

1. Technical Field

The present invention provides a balloon weight system for an inflatable balloon having, singularly or in any combination, an electronic music producing device, a line distance adjusting device, to produce a descending and/or ascending of the balloon, and a fragrance distribution device.

2. Background Art

The present invention relates to an anchor for fixedly tethering a balloon. Balloons, including lighter-than-air balloons, are well-known in the art. Lighter-than-air balloons are used for decorations at parties, given as gifts, and presented to persons with floral or other arrangements at special occasions such as graduations, birthdays, Valentine's Day, and Mothers' Day. Such balloons often bear indicia of the occasion, such as "Happy Birthday," "Over the Hill," or "Congratulations."

Lighter-than-air balloons are typically filled with helium, but may be filled with any lighter-than-air gas. Thus, the balloons float in air. The balloons may be made from a variety of materials, including natural or synthetic rubber, polyester, metallized polyester, nylon, or metallized nylon. If untethered, the balloons would float uncontrolled.

Often, for display in retail stores, balloon weights have been employed, with the balloon attached to the weight by a string or ribbon. Weights, however, may be unsightly, and string or ribbon must be tied to the weight. Balloons are also sometimes tied to any stable object to prevent them from floating away. Tying and untying balloons when a customer purchases them is time-consuming for the store clerk.

Balloon weights have been developed that have a pre-assembled weight, a length of ribbon, and sometimes a means to attach the balloon to the ribbon. Examples of such weights are disclosed in U.S. Pat. Nos. 5,989,093 and 6,076,758 and U.S. Patent Application Publication No. 2003/0197084 each of which is incorporated herein by reference and made a part hereof. These prior art balloon weights often have hooks extending from them, and are adapted to be hung from a peg.

Inflatable balloons having an electronic music making device attached thereto is known in the art. It is also known to have a balloon weight having an electronic music making device and speaker housed within the balloon weight. It is also known to have inflatable balloons that are illuminated by externally and internally positioned lighting devices. It is also known to have inflatable balloons having scented ink for printing on the surface. It is also known to provide a balloon having a valve having an internal compartment for holding a scented tablet whose fragrance must pass through the balloon material to produce a scented balloon.

These and other aspects and attributes of the present invention will be discussed with reference to the following drawings and accompanying specification

DETAILED DESCRIPTION OF THE INVENTION

Figure 1:
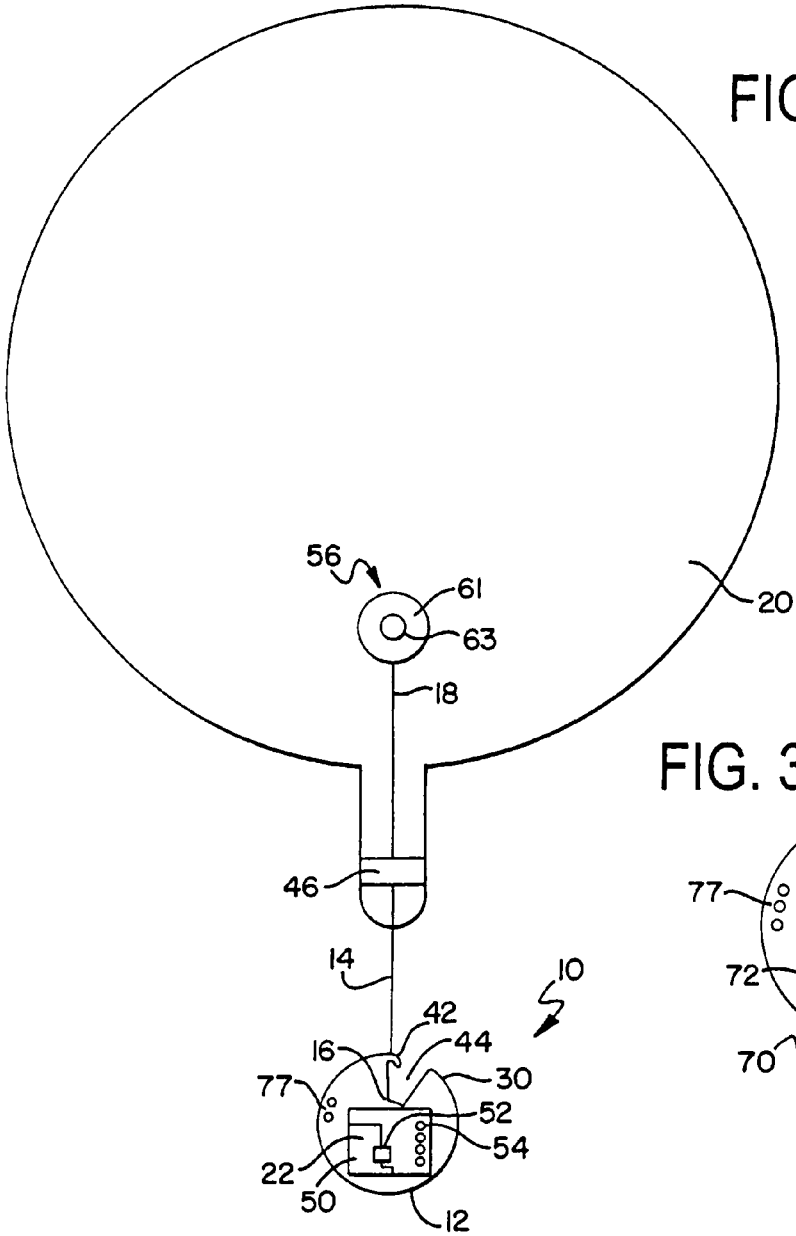
FIG. 1 is diagrammatic view of a musical balloon weight of the present invention attached to an inflatable balloon.
Figure 3A:
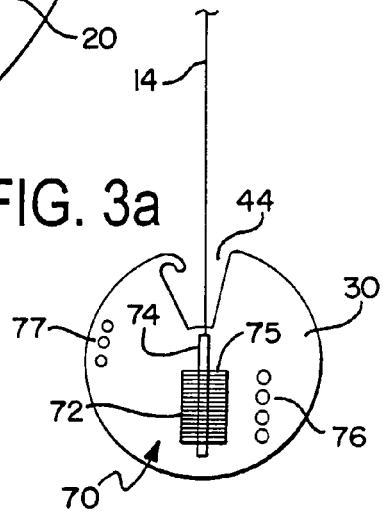
FIG. 3*a* is a diagrammatic view of a reciprocating-type line distance adjusting device in the far position.

While this invention is susceptible of embodiment in many different forms, there is shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 shows a balloon weight system 10 having a balloon weight 12 and a line 14. The line 14 has a first end 16 connected to the balloon weight 12 and a second end 18 which is adapted to attach to an inflatable object 20. The balloon weight 12 has a device 22 associated therewith that provides a function such as playing music or sounds from the inflatable object, or a line distance adjusting device for causing the inflatable object to ascend or descend, or a fragrance distribution device to distribute a fragrance from the balloon weight 12. The present invention contemplates the balloon weight 12 can contain one or any combination of these devices including all of the devices in the same balloon weight 12.

The balloon weight 12 typically will have a front wall 30 or both a front wall 30 and a rear wall 32, and optionally a spool 34 for storing the line 14 or a portion of a length thereof. In a single wall embodiment the device will, in a preferred form of the invention, be covered with a protective covering (not shown) such as a film, label, tape or the like. The covering can also provide access to a switch or other activation mechanism for activating the device 22.

Figure 2:
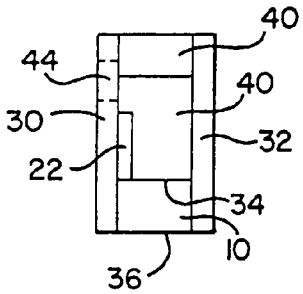
FIG. 2 is a side view of the balloon weight shown in FIG. 1.
Figure 3B:
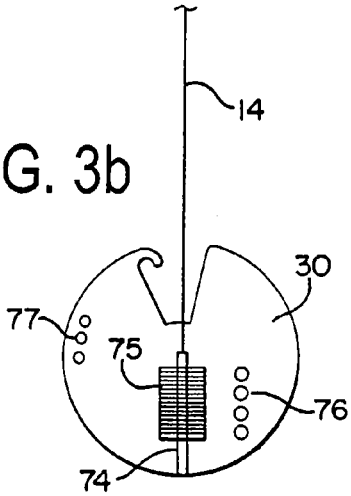
FIG. 3*b* is a diagrammatic view of a balloon weight system having a reciprocating-type line distance adjusting device shown in the near position.
Figure 4A:
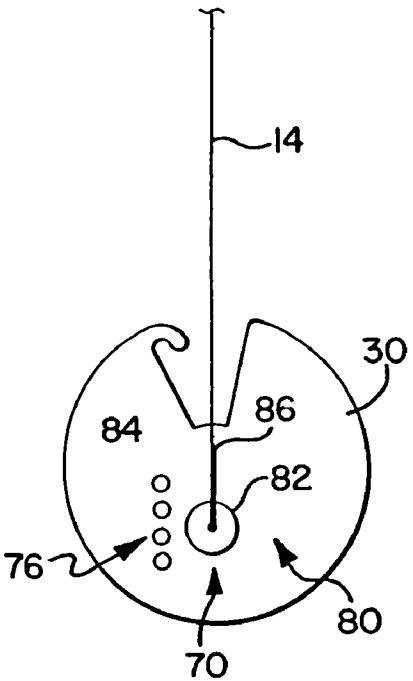
FIGS. 4*a*-4*d* is a diagrammatic view of a balloon weight system having a camming-type line distance adjusting device shown in an ascending position in FIG. 4*a* and in descending positions shown in FIGS. 4*b*-4*d*.
Figure 4B:
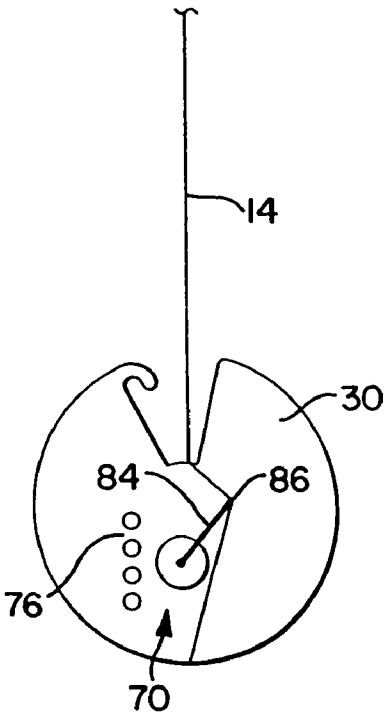
Figure 4C:
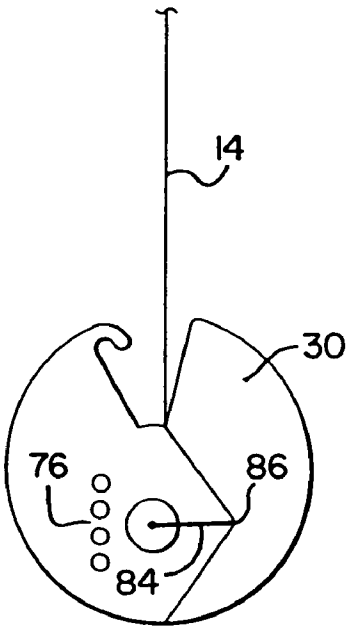
Figure 4D:
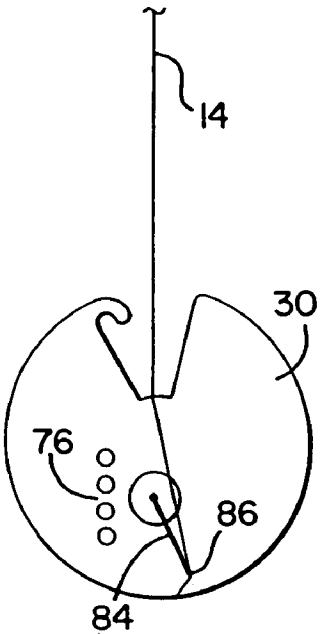
Figure 6:
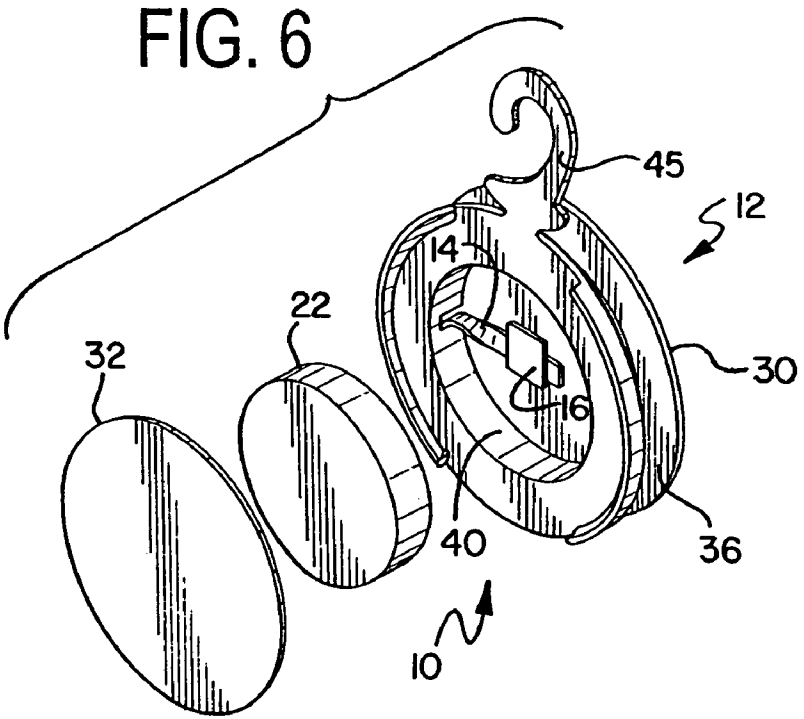
FIG. 6 is a balloon weight of the present invention and a front and rear walls differing in shapes.

For embodiments having a front and rear walls 30, 32 (FIG. 2) the front and rear walls can have essentially the same shape or they can have differing shapes (FIG. 6). In one preferred form of the invention one or both of the front and rear walls 30, 32 will have an optional flange 36 extending axially from a circumferential portion of the front wall or the rear wall for forming a sealed compartment 40 or compartments when assembled. The front wall 30 can be fixedly or removably joined to the rear wall by snap fitting, adhesive or other well known method for joining such pieces.

The front wall or the rear wall shown have a generally circular shape but could have other shapes without departing from the scope of the invention. Such shapes include figural shapes such as representing animals; vehicles, such as automobiles, motorcycles, trucks, fire engines, police cars; molecules, biological cells, trademarks and logos, flowers, plants, trees, animated characters, and numerous other shapes that can be contemplated and are too numerous to list here.

In a preferred form of the invention, the front wall or the rear wall or both will have a hook like projection 42 or the like for attaching the weight to a peg or other object. In the embodiment shown in the FIGS. 1-5 a portion of the front wall is removed 44 to define the hook. It is also possible to provide a hook-shaped object 45 (FIG. 6) projecting from an outer circumference of the wall without removing a portion of the wall.

The walls of the balloon weight can be formed from essentially any material including paper, plastic, wood, cork, ceramic, metal, glass, or other moldable material such as plaster, and chalk. In a preferred form of the invention, the walls are formed of plastic and preferably a thermoplastic such as polymers, copolymers and terpolymers formed from one or more monomers such as olefins, styrenes, esters, amides, urethanes, acrylates, acrylonitriles and dienes. In a preferred form of the invention, the walls are formed using an injection molding process.

The line 14 can be a ribbon, string, rope, wire or wires, thread, yarn, cable, fiber optic cable, coaxial cable, cloth, paper, silk, fishing line and the like. It is contemplated the line 14 can be decorated such as with sparkling or light reflecting material or can be graduated for distance measurement like a tape measure. The line 14, in a preferred form of the invention, is attached to the inflatable object 20 with a piece of tape 46 or adhesive or other method that does not pierce the material of the inflatable object.

The inflatable object 20 is preferably a balloon. The balloon can be filled with air or, in a more preferred form of the invention; a gas that is lighter than air and that is not readily combustible such as helium. The balloon can be formed of materials such as natural or synthetic rubber, but for lighter than air balloons it is desirable for the material to provide a barrier to the passage of helium. Such materials include films including a layer of metal, EVOH and/or PVDC. In a preferred form of the invention the balloon material is a metalized polyester or a metalized nylon and most preferably a metalized poly(ethylene terephthalate) (PET). Suitable PET includes the material sold by Dupont under the trademark MYLAR®.

The music producing device 22 for producing music in or on the inflatable object includes a printed circuit board 50, a chip or memory device 52 on the board for storing a desired sound or series of sounds, and a battery 54. The music producing device is capable of generating a signal by modulating voltage or amplitude or the like for producing audible sounds representative of the desired sound through an acoustic medium 56 remotely located from both the device 22 and the balloon weight. The desired sounds can include a tone, a series of tones, music, a sound recording, a song recording, a voice recording, or the like. The circuit board 50 can be attached to the wall 30 using tape, adhesive, or by the protective covering mentioned above, or other method or mechanism.

It is also contemplated that the music producing device can have a microphone that allows for recording of a voice message or allows a user to speak into the microphone and have his or her voice heard as it resonates from the inflatable object.

The acoustic medium 56 is attached to the inflatable object and, in a preferred form of the invention, vibrates the balloon wall in response to the signal generated by the circuit board 50 or chip to cause the desired sound to audibly resonate from the balloon. In a preferred form of the invention, the acoustic medium 56 is a piezoelectric device and more preferably a bimetallic piezoelectric diaphragm. The bimetallic diaphragm has two different metals and preferably a first type metal 61 in a first outer circumferentially extending ring and a second type metal 63 in a central portion of the diaphragm. The diaphragm is preferably attached to an outer surface of the balloon wall using an adhesive on a surface of the diaphragm or by adhesive tape.

A signal produced from the music producing device is carried through the line 14, which in this case, is a pair of insulated electrical wires, for delivering a signal to the acoustic medium. Suitable music producing devices and the diaphragms can be purchased from DSW International.

The music producing device 22 can also include an on/off switch. The switch can be activated by numerous ways such as by pressing a control on the device, or by pressing the front wall or rear wall, by light activation, by movement of the balloon weight and the like.

FIGS. 3*a*, 3*b*, 4*a*-4*d* and 5 show balloon weights containing line distance adjusting devices 70 for moving the second end of the line from a first position to a second position with respect to the balloon weight. In a preferred form of the invention, the first position (far position or up position) will have the second end of the line a first distance from the balloon weight and in the second position (near position or down position) the second end will be a second distance from the balloon weight where the second distance is shorter than the first distance. When a lighter than air balloon is attached to the second end and the line distance adjusting device is activated, the balloon will descend when the line distance adjusting device moves the line from the first position to the second position. The balloon will ascend as the line is moved from the second position to the first position. This will produce an alternating descending, ascending effect in the balloon.

In one preferred embodiment, the line distance adjusting device has a shuttle mounted for reciprocating translational movement. In one preferred form of the invention, the reciprocating device 70 is a solenoid 72 having a shuttle 74 mounted for reciprocating translational movement between an up position and a down position (reciprocating-type), FIG. 3*a*, FIG. 3*b*; a power coil 75 and batteries 76. The second end of the line is connected to the shuttle 74. The shuttle 74 can provide a reel (not shown) for making rough adjustment to the length of the line so the balloon will descend and ascend within the desired vertical space such as a portion of the distance between a ceiling and the top of furniture where the balloon will be visible to people within the room.

In another preferred form of the line distance adjusting device 80 has a rotating element 82. The rotating element can rotate in a clockwise direction, a counterclockwise direction or alternating between these opposite rotational directions. In one preferred form of this embodiment, an arm 84 is attached to the rotating element 82. The element rotates in response to a motor (not shown) powered by a battery or batteries 76. A distal end of the arm 86 engages a portion of the line during a first portion of the rotation, shown in FIGS. 4*b*-4*d* (camming-type), to move the line between the up and the down positions. During a second period of rotation the arm does not engage the line and the line is drawn to the up position by the lifting force of the lighter than air balloon. In a preferred form of the invention, the first period and the second period are essentially equal in degrees of rotation. Also, in this embodiment the arm contacts the line at a point on the line intermediate the first end and the second end, and the first end will be attached to another portion of the body or to the device so that the line is taught at the section of line where the arm cooperatively engages the line.

Figure 5:
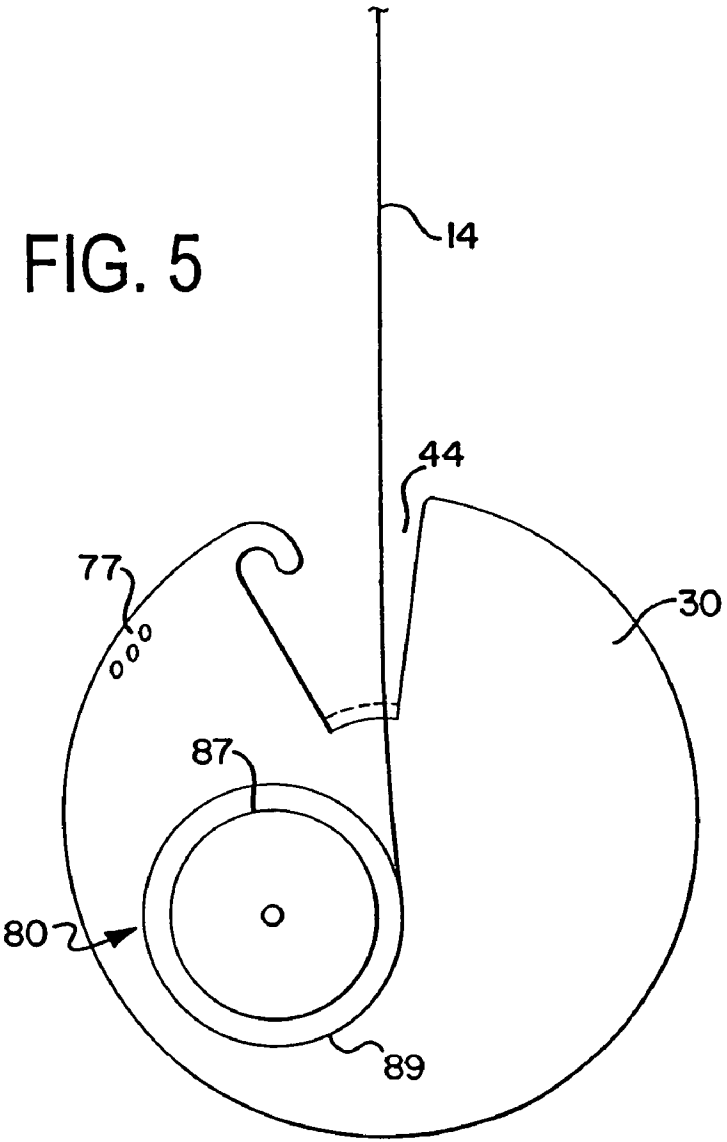
FIG. 5 is a diagrammatic balloon weight system having a spooling-type line distance adjusting device.

In another embodiment shown in FIG. 5 the rotating element is a reel 89 for winding and unwinding the line (spooling-type) and is rotated by a reciprocating stepped motor (not shown). The motor can have a shaft 87 that is attached to the reel or can be attached to the reel with a belt or chain or through gears. The reel can rotate at the same speed of the shaft or at higher or lower rotational speeds determined by the mechanism linking the shaft to the reel. The motor rotates the element in a direction alternating between a clockwise direction and a counterclockwise direction. The first end of the line is attached to the reel so that rotation of the reel in a first direction takes up line and when rotated in a second opposite direction releases line. Thus, the lighter than air balloon descends as the line is wrapping about the reel and ascends as the line unwinds from the reel.

The reciprocating motor can come preprogrammed to specify such parameters as the distance of travel between high and low positions (that is, between the first and the second positions), the rotational speed of the reel and the like. By specifying these parameters the device could be programmed to move the lighter than air balloon in an ascending and descending pattern that is particularly desirable in visual effect. One particularly preferred example would be to create the motion of a Dolphin swimming through water by taking a decorative balloon in design and shape of a Dolphin and then to take such object and cause it to move in an up and down fashion at a speed to resemble a swimming Dolphin.

The motor may also be preprogrammed to travel a specific distance between high and low positions. For most environments such as in residential homes, banquet halls, offices, hospital rooms, the length of distance between the first and second position should be anywhere from about 4 inches to about 60 inches. For external environments or indoor environments where high ceilings are encountered it may be desirable to allow the balloon to travel anywhere up to 50 ft between high and low positions but it is likely for most applications 10 feet distance of line of travel should be more than adequate.

It is also contemplated that the reciprocating motor can come with controls for specifying the same parameters mentioned above in the preprogrammed model. Suitable controls include both analog-type and digital-type controls. The controls can be simple or complex. A simple type control may include a device for allowing a user to select between HIGH MED LOW settings or a control that allows a sliding scale type selection of anywhere between the distance ranges mentioned above.

The settings can be input by both simple and complex methodologies. A simple methodology includes operating a simple device as one having a single button on the balloon weight to create a visual or audible indication of the setting selected. Other simple visual displays may include a single button that allows selection between the various settings. It is also imagined that a button could be dedicated for each selection. The settings can be displayed visually with an LED or other manner of illumination to create a visual perception of the setting. It is also contemplated the level indication could be indicated by an audible tone, by the number of tones or the pitch of the tone to indicate the setting. The controls also could be a digital control with a more complex visual display or audible indication. It is also contemplated using more sophisticated entry tools such as a keypad that functions like a computer keyboard, a cell phone keypad (QWERTY) or PDA keypad.

It is further contemplated the line distance adjusting device can be adapted to respond to the sound of music from the balloon or from another source. The balloon weight can be made to move in response to the beat of the music, the speed or tempo of the music, to the volume or other aspect of the music. Devices capable of responding to music are well known in the art and have been incorporated into toys.

The balloon weight can also have a light or a series of lights 77 that can be turned on by a switch or other activation device and can be incorporated into the balloon weight with one or more of the devices disclosed herein. As with the other functions of the devices, the light or lights can be connected to a circuit located within the balloon weight that causes the light or lights to flash in response to music or other external stimuli.

The balloon weight system can also include a compartment 40 for containing a fragrant material and a vent or opening in the balloon weight for the fragrance to be distributed in the environment surrounding the balloon weight. The balloon weight system can also include an internal or external surface on the front or rear walls 30, 32 where a fragrant material; such as a scented pad, tape or label; can be attached and the fragrance distribution from the material can be initiated by removing a protective tape or film from the fragrant material. The fragrant material can be a solid, liquid or gaseous form. The fragrant material can also be of any desirable fragrance such as natural fragrances such as of a fruit, tree, spice, herb, flower, plant and soil to name a few. The fragrant material can, optionally, be held in a pouch or other similar container to prevent the fragrance from being distributed until the end user wishes for it to be. The container or pouch can be pierceable or otherwise activated from outside the balloon weight. An internal surface of the balloon weight may include a piercing element (not shown) that will pierce the fragrant pouch by pushing an exterior surface of one of the walls of the balloon weight or a button on the exterior of the balloon weight that moves the piercing element toward the fragrant material.

The fragrance distribution device can also include an air distribution device such as a fan blade that is rotated by a motor positioned in the balloon weight to rotate the fan blade. It is also contemplated that the motor mentioned above for the line distance adjusting device could also be used to rotate both the fan blade and the line distance adjusting device (particularly the camming-type and the spooling type).

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A balloon weight system comprising:

a balloon weight having a projection for attaching the balloon weight to an object;

a line having a first end and a second end, the first end is associated with the balloon weight and the second end is connected to a piezoelectric member; and a device on the balloon weight selected from the group consisting of a sound producing device, a line length distance adjusting device and a fragrance distribution device, the sound producing device capable of generating a signal representative of a sound and sending the signal through the line to the piezoelectric member where the sound signal is converted into sound in an inflatable object.

2. The system of claim 1 wherein the sound producing device comprises a printed circuit board, a chip, a power source and an acoustic medium connected to the second end of the line.

3. The system of claim 2 wherein the piezoelectric member has a surface with an adhesive for attaching to a surface of an inflatable object.

4. The system of claim 3 wherein the piezoelectric member comprises a bimetallic diaphragm.

5. The system of claim 2 wherein the line is an electrical conduit.

* * * * *